United States Patent [19]

Mackiewicz

[11] Patent Number: 4,827,386

[45] Date of Patent: May 2, 1989

[54] WATER-PROOF AND IMPACT-RESISTANT LIGHTING FIXTURE

[75] Inventor: Edward T. Mackiewicz, Elmwood Park, Ill.

[73] Assignee: Kenall Manufacturing Co., Chicago, Ill.

[21] Appl. No.: 219,199

[22] Filed: Jul. 8, 1988

[51] Int. Cl.[4] ..... F21V 29/00; F21V 15/00

[52] U.S. Cl. ..... 362/267; 362/147; 362/225; 362/294; 362/373; 362/375

[58] Field of Search ..... 362/147, 218, 225, 247, 362/310, 374, 375, 294, 373

[56] References Cited

U.S. PATENT DOCUMENTS

| | | | |
|---|---|---|---|
| 3,185,835 | 5/1965 | Müller et al. | 362/225 |
| 3,419,714 | 12/1968 | Slauer | 362/218 X |
| 3,991,905 | 11/1976 | Nicpon | 362/375 X |
| 4,059,753 | 11/1977 | Tart et al. | 362/267 |
| 4,580,200 | 4/1986 | Hess et al. | 362/267 X |
| 4,713,916 | 12/1987 | Brooks, Jr. | 362/197 X |

*Primary Examiner*—Michael Koczo
*Assistant Examiner*—Peggy Neils
*Attorney, Agent, or Firm*—Michael G. Berkman

[57] ABSTRACT

A lighting fixture having a unitary, combination pan-like, wrap-around housing integrally formed with a refractor lens of high-impact plastics material. The housing is hermetically sealed to a heat-dissipating cast metal plate of the fixture through the medium of a resilient sealing bead interposed and mechanically confined between a base flange extending outwardly of bounding side walls of the housing and a face of the base plate at a marginal zone thereof. The housing is stressingly urged against the sealing bead by means of housing and plate-carried inter-engaging tabs and slots in conjunction with threaded bolts exending through side walls of the housing and matingly engaging threads in bores formed in posts integrally formed with the base plate. The bores are angled so as to effect a positive displacement of the housing toward, to seal with the base plate during threaded advance of the bolts into the threaded bores of the base plate. The fixture houses twin parabolic reflectors and the housing also encloses and protects the reflectors as well as all of the electrical components of the fixture, including ballasts. The latter are mounted on solid metallic pedestals integrally formed with the cast base plate, and constituting heat sinks for dispelling heat generated in the ballasts during energization of the fixture.

8 Claims, 3 Drawing Sheets

FIG. 1
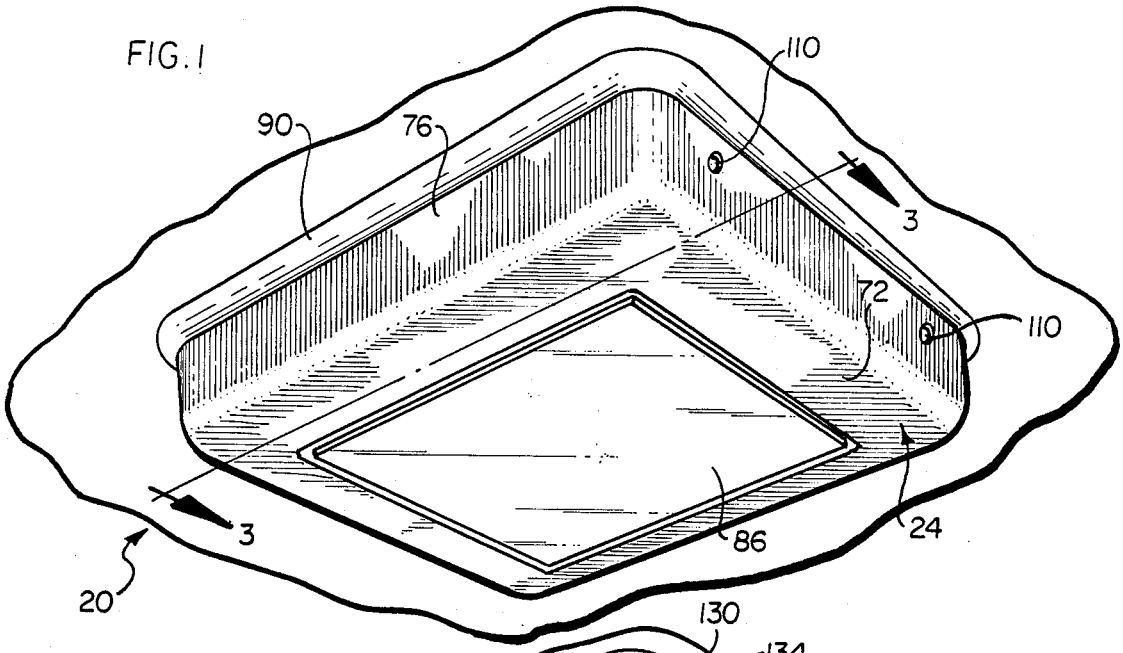
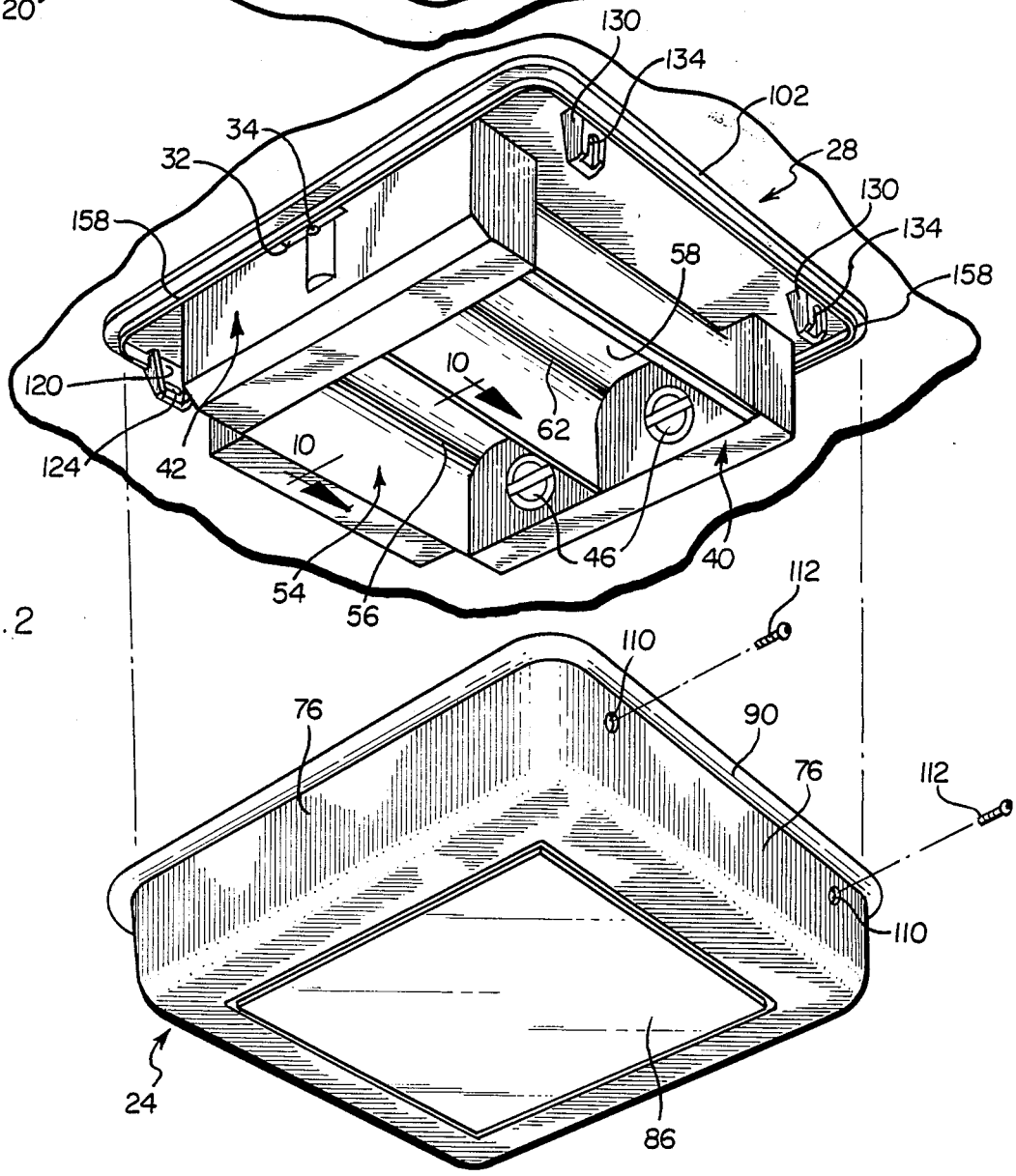
FIG. 2

WATER-PROOF AND IMPACT-RESISTANT LIGHTING FIXTURE

BACKGROUND OF THE INVENTION

The present invention relates to electrical lighting fixtures. More particularly, the invention is directed to a lighting fixture attachable to either a wall or ceiling, or soffit, and which is hermetically sealed so as to be safely operable in the presence of ambient moisture vapor. The lighting fixture of the invention is further characterized in that it is specifically constructed and engineered so as to be capable of withstanding the exposure present in what may be considered "high-abuse" areas, such as are found in schools, public housing units, apartments and condominums, and government facilities.

While other lighting fixtures intended for use in such high abuse areas are known in the art, the physical configuration of such fixtures and the electrical opponents and illuminating elements of such fixtures dictate their adoption for use in areas which differ from those in which the present fixture finds special utility. Moreover, many of the prior art fixtures are not sealed effectively against the ambient atmosphere and, accordingly, can not be used in wet locations. Others of prior art fixtures fail to provide the illumination required or desired in use. In many cases it has been found difficult to combine and provide good illumination in fixtures which also are unobtrusive and aesthetically pleasing and compatible with diverse decor and interior decoration.

Notwithstanding the extensive research and developmental work which has been carried out and the intense engineering programs pursued, significant problems exist in the commericial and industrial lighting field. It is to the effective resolution of some of such problems and to the elimination of the inadequacies and objectionable features of prior art lighting fixtures that the present invention is directed. It is a principal aim of the present invention to provide a lighting fixture which is simple in construction, safe in operation and which at the same time provides excellent illumination and is aesthetically pleasing.

SUMMARY OF THE INVENTION

It is an important feature of the present invention that the improved lighting fixture utilizes a minimum of body components, thus ensuring effective sealing against the ambient environment, and simplified maintenance.

A related feature of the fixture of the invention is that it includes only two "outer" components, namely a wrap-around lens and housing structure in combination with a base plate.

An important structual feature of the fixture of the invention is that the combined housing and lens are fabricated as a unitary injection molded structure of impact resistant polycarbonate plastics.

A related feature of the invention is that the cast plastic lens and housing has a smooth outer finish facilitating cleaning.

Yet another feature of the invention is that the base plate of the fixture is fabricated of rugged, die-cast aluminum and is highly corrosion resistant.

An important feature of the lighting fixture of the invention, contributing to the moisture impermeability of the assembly is the provision of a fluid tight neoprene rubber gasket ring interposed between and stressingly confined between the housing of the fixture and the base plate which provides a fluid impervious seal excluding moisture and insects from the interior of the fixture.

An important practical and aesthetic feature of the fixture of the invention is that the molded polycarbonate lens may take various forms as an opal white diffuser or as a clear (transparent) and as a clear prismatic refractor. The outer finish may be in any preferred color or may be a diffuser which is not painted at all.

Among the engineering improvements found in the fixture of the invention is the use of a cool running ballast insuring longer life.

A related feature of the invention is the incorporation of recessed twin tube lamps in an unobtrusive polycarbonate housing to achieve the aesthetic qualities of recessed lighting without the usual associated expense.

A related feature of the fixture of the invention is the use of twin tube parabolic reflectors to achieve long fixture spacing in hallways and in soffit applications. The reflectors provide uniform light output and allow for wider spacing-to mounting-height ratios.

Related engineering advantages of the fixture of the invention are associated with the utilization of preheat, cool operating ballasts and the provision of heat dissipation means to ensure prolonged ballast life.

An important feature simplifying installation and maintenance of the fixture is the provision of semicaptive screws which secure the lens to the back plate. Relamping is quickly and easily carried out.

A general important feature of the lighting fixture of the invention is that the wrap-around combination lens and housing encloses and protects all metal components from the elements. An essentially inert resilient elastomeric sealing element prevents moisture and insects from invading the interior of the lamp assembly.

An important assembly feature of the fixture of the invention is that upon tightening the screws which lock the housing onto the base plate, the housing is shifted toward the base plate to compress the interposed sealing ring and to ensure a fluid tight seal.

It is a feature of the fixture of the invention that the housing is fabricated of a shock and shatter-resistent plastic material and that the base plate is of a heat dissipating metal such as aluminum, more effectively to dissipate developed heat and thus to contribute to a longer useful life for the electrical components and for the fixture as well.

A related feature of the invention is that the heat generating ballasts are mounted on special metal pedestals integrally formed with the base plate and ensuring maximum heat dissipation and distribution from the ballasts themselves.

Yet another feature of the invention is that the base plate is provided with a circumambient skirt ensuring proper alignment of the housing with the base plate when the latter are assembled.

Other and further features and advantages of the invention will be evident upon a reading of the following detailed description considered in conjunction with the drawings.

BRIEF DESCRIPTION OF THE DRAWINGS

FIG. 1 is a perspective view of a ceiling-mounted lighting fixture according to the invention, as viewed from below;

FIG. 2 is an exploded view of the fixture of FIG. 1 with the shell and lens assembly detached from the base plate of the fixture;

DETAILED DESCRIPTION OF ILLUSTRATED EMBODIMENT

The aims and objects of the present invention are achieved, in accordance with the practice of the invention by providing a fluorescent fixture having two (outer) components, namely a combination lens and housing and a mounting plate or base plate. The unitary housing and lens of "unbreakable" high impact strength plastics is hermetically sealed on the base plate to establish an essentialy fluid tight assembly precluding the entry of ambient moisture. The high strength, impact resistant and shatter-proof plastic housing and lens are preferably fabricated of polycarbonate. The base plate is preferably cast of aluminum or of an aluminum containing alloy.

The internal components of the fixture including the modified parabolic reflectors, the lamps sockets and lamps, and the ballasts or ballast transformers are fastened on the base plate, the socket assemblies and the ballast being encased within protective canisters at opposed sides of the fixture. In the specific embodiment of the fixture illustrated, the parabolic reflectors extend between and are carried by the opposed canisters.

The illuminating elements are two thirteen watt 2700 degrees K high efficiency twin tube lamps. In its final assembled and ceiling-installed state, the fixture is Underwriter Laboratories approved for wet locations.

Figure 3:
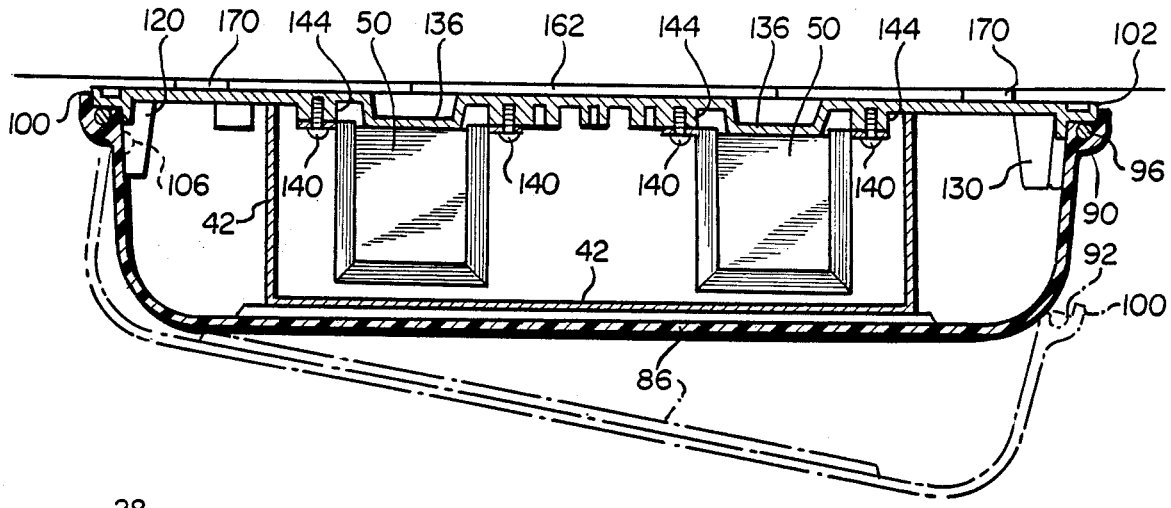
FIG. 3 is a cross-sectional view taken substantially on the lines 3—3 of FIG. 1 showing the arrangement of electrical components within the body of the fixture and indicating the housing hingedly pivoted to an open position of the fixture.

Referring more particularly to the drawings, and specifically to FIGS. 1 and 2, for purposes of illustrative disclosure and not in any limiting sense, one preferred embodiment of the lighting fixture 20 of the invention is shown as including a unitary combination of housing or shell and lens 24, and a base plate 28 on which the housing-lens unit 24 is mounted. Fastened to the base plate 28 by means of tabs 32 and screws 34 are a pair of laterally spaced, elongated metal canisters 40 and 42 which protectively enclose the tube-mounting electrical sockets 46 and the ballasts or ballast transformers 50 (FIG. 3). A reflector 54 is shown as including two laterally positioned, modified parabolic reflecting surfaces 56 and 58 in which the trough-like portion of the parabolic surface includes an elongated zonal section 62 which is displaced inwardly of the parabola and extends along the length of the reflector.

The shell-like housing 24 is generally rectangular in configuration, with rounded corner and top edge portions 70 and 72, and side walls 76. The top face of the panel 80 of the shell or housing 24 is integrally formed with a light transmitting luminous, window-like lens 86 which may be completely clear and transparent or which, alternatively, may be formed with a grid like refracting undersurface.

Circumscribing the housing 24 at its base and projecting laterally from the side walls 76 is a flange 90 formed with an outwardly open moat-like groove or channel 92 in which there is seated a bead-like gasket 96, a upper exposed face of the gasket 96 protrudes outwardly of the trench or trough 92 and defines an interface surface for stressingly engaging and sealing against the base plate 28 of the fixture, as more fully described herebelow. As shown in FIG. 3, the flange 90 is formed at its periphery with a downwardly projecting, circumscribing annular rim 100 which embraces an outer bounding edge 102 of the base plate 28.

Figure 7:
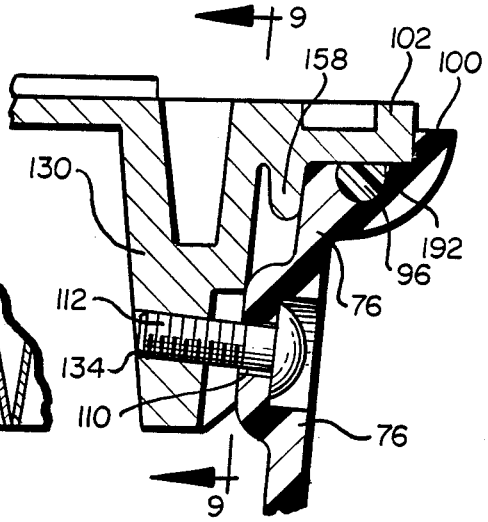
FIG. 7 is a cross-sectional view taken substantially on the lines 7—7 of FIG. 4 and showing the interengaging coupling flanges (seen also in FIG. 6) of the base plate and the housing, and a headed and angularly directed locking screw threadedly securing the housing in bead-stressed sealing engagement against the base plate of the fixture.
Figure 8:
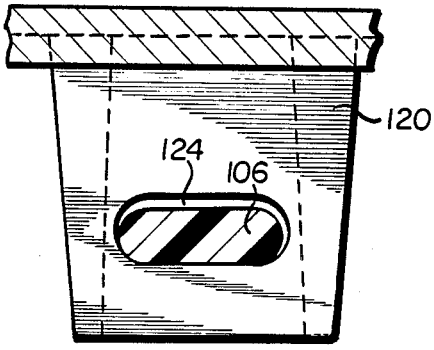
FIG. 8 is a cross-sectional view taken substantially along the lines 8—8 of FIG. 6 and showing the pivot base pressing against the lower wall of the hinge slot formed in the base plate of the fixture.
Figure 9:
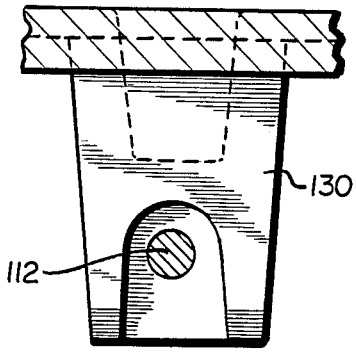
FIG. 9 is a cross-sectional view taken substantially on the lines 9—9 of FIG. 7 and showing the shaft of the locking screw intercoupling the fixture shell to the base plate.

Referring further to the plastic shell or housing 24, a pair of laterally spaced tabs 106 integrally formed with a sidewall 76 of the shell protude inwardly of an interface of the sidewall 76. At a side opposite the side which carries the tabs 106, the sidewall 76 of the shell 24 is formed with a pair of laterally spaced holes 110 for accomodating locking screws 112, as shown in FIGS. 2 and 7.

Figure 4:
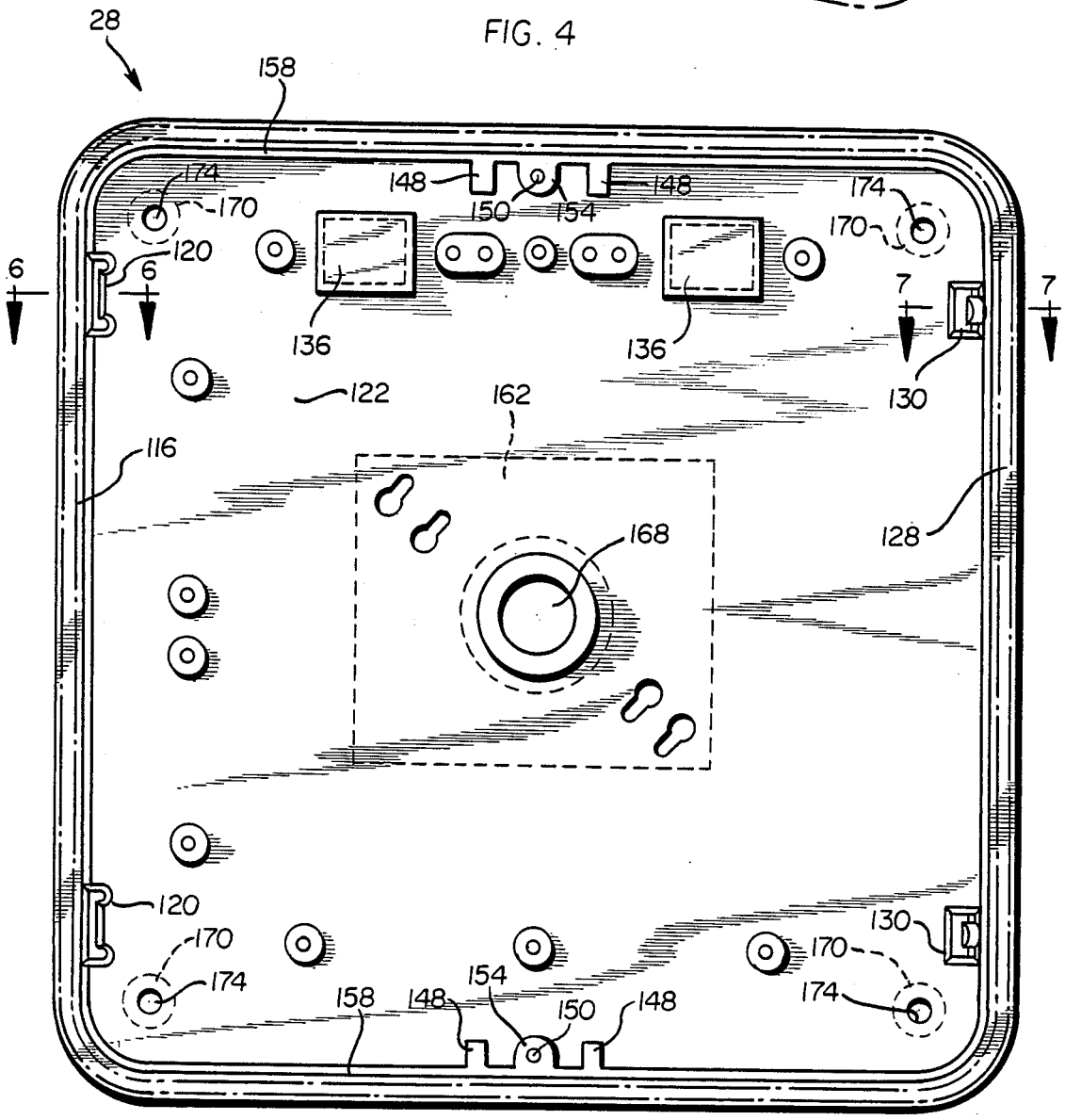
FIG. 4 is a plan view showing the base plate of the fixture as seen from the inside of the fixture.
Figure 5:
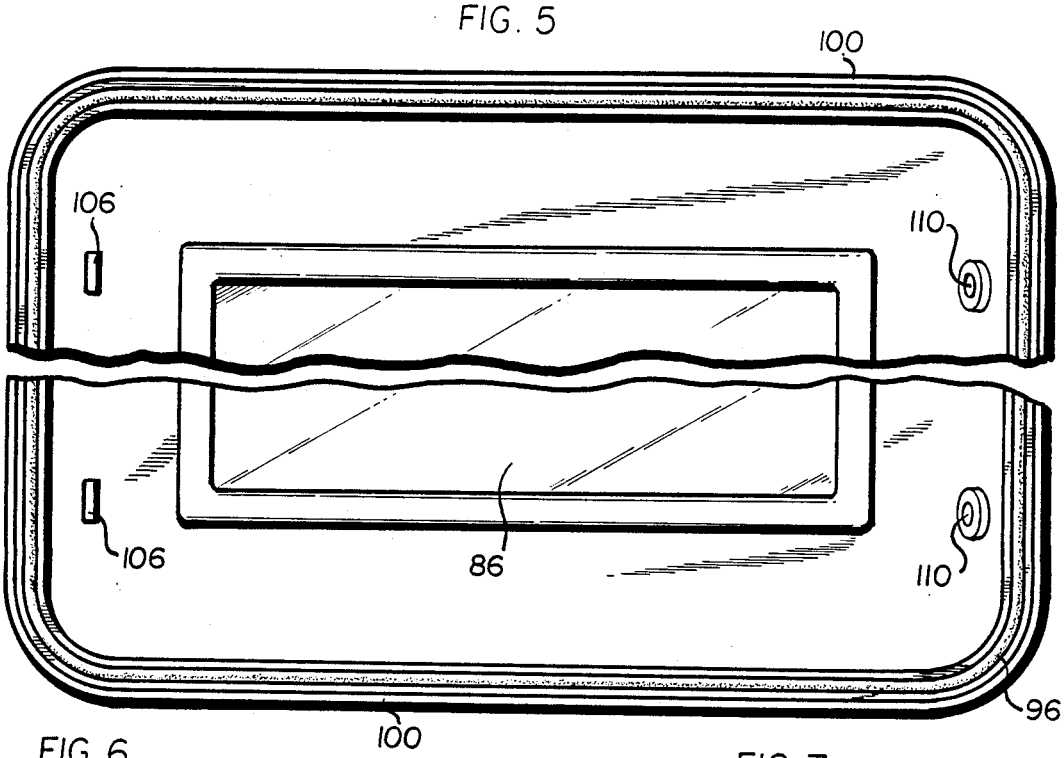
FIG. 5 is a plan view with parts cut away, and showing the inside of the cover shell of the fixture.

Referring now to FIGS. 1 and 4, the metal base plate 28 is shown as carrying along one lateral edge zone 116 thereof a first pair of posts 120. The posts 120 are integrally formed with and extend upwardly of the floor 122 of the base plate 28 and are formed with socket-like slots 124 for receiving the tabs 106 of the housing 24 during assembly of the fixture 20.

At a side edge 128 opposite the side 116 which carries the posts 120, the base plate 28 carries a second set of posts 130, these being integrally formed as part of the base plate 28 and projecting upwardly of the floor 122 of the base plate 28. As shown in FIGS. 1 and 7, the posts 130 are formed with threaded bores 134 for receiving the matingly threaded screws 112 which extend through the sidewall 76 of the shell 24 and lock the shell 24 and the base plate 28 to each other.

The base plate 28 is also formed with a pair of raised pedestals 136 on which the ballasts or ballast transformers 50 stand, the ballasts 50 being secured in place by means of screws 140 which are threaded into bosses projecting upwardly of the floor 122 of the base plate 28 and integrally formed therewith. The pedestals 136 serve as heat sinks or heat dissipating structures for dispelling and distributing heat generated in the ballasts 50 during operation. The arrangement described ensures a lower operating temperature for the assembly and extends the useful life of the electrical components.

Referring further to the base plate 28, and as shown in FIG. 4, the base plate 28 is formed with upstanding support piers 148 which serve as supports for the wing-like tabs 32 of the canisters 40 and 42 which carry the reflector assemblies 54. The screws 34 which extend through the tabs 32 are threadedly received in cooperating threaded bores 150 of bosses 154 carried on the base plate 28. The base plate 28 is also integrally formed with an encircling upstanding flange or skirt 158. As shown in FIG. 7, the skirt 158 of the base plate 28 nests interiorly in and against the side walls 76 of the housing 24 serving both as an alignment-insuring structure and to enhance the effectiveness of a fluid-tight seal established between the base plate 28 and the surmounting housing 24.

As means for further insuring the vapor impermability of the fixture, and as indicated in FIGS. 3 and 4, a compressibly resilient sealing pad 162 adhesively bonded to an outer surface 164 of the base plate 28 encircles a central opening 168 in the base plate 28 through which electrical conductors communicate with the interior of the fixture assembly. Moisture-impervious and resiliently-compressible sealing washers 170 are adhesively bonded to the base plate 28 on its under surface 164 in zones encircling through holes 174 used in attaching the fixture to a supporting substrate.

Figure 10:
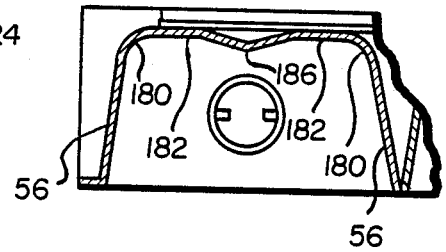
FIG. 10 is a cross-sectional view taken substantially on the lines 10—10 of FIG. 2 and showing the configuration of the modified parabolic reflectors.

As has previously been indicated, the reflectors used in the practice of the present invention are of a configuration which may be characterized as modified parabolic. As shown in FIG. 10, the generally straight though diverging side walls 56 of the reflector 54 blend into intermediately disposed arcuate sections joined to planar sections 182 extending in a substantially horizontal mode. The mid-zone of the reflector 54 is vaulted inwardly 186 toward the lighting tube element. It has been found that the reflector structure described provides enhanced values of important light distribution parameters, and improved illumination.

The manner in which the cooperating structual components of the fixture of the invention ensure fluid-tight sealing between the base plate 28 and the housing 24 will be evident from the foregoing description considered in conjunction with the drawing.

The following brief comments are provided further to point out the important principles invoked in effectuating the aims of the present invention.

Figure 6:
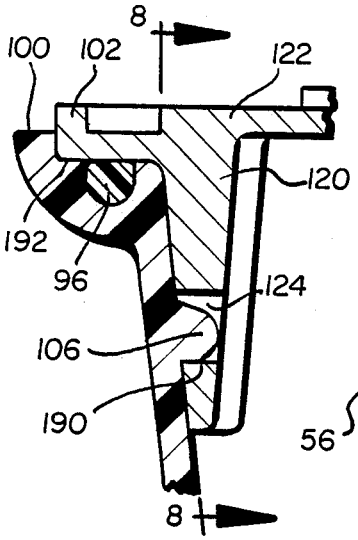
FIG. 6 is a cross-sectional view taken substantially along the lines 6—6 of FIG. 4 and showing the shell-carried sealing bead compressed against the base plate to seal the shell with the base plate, and the shell-carried tab seated in a cooperating plate-carried hinge slot of the fixture and holding the shell and the base plate in stressed sealing engagement.

Referring now to FIGS. 3, 6 and 7, in readying the housing 24 for attachment to the base plate 28, a first step is slideably to insert the housing carried tabs 106 into the slots 124 formed in the posts 120 of the base plate 28. The tabs 106 and the slots 124 then function as a hinge while the housing 24 is pivoted toward to overlie and to abut the base plate 28, as shown in FIG. 3, and in a final position, in FIG. 7. Referring further to FIG. 7, it will be noted that the threaded bore 134 in the leg 130 of the base plate 28 is pitched or angled so that as the screw 112 is threadedly advanced into the opening 134, the housing 28 is urged toward the base plate 24 exerting a positive compression force against the sealing gasket or bead 96. At the same time, at the opposite side of the assembly, the tab 106 of the housing 24 cams upon a lower wall 190 bounding the slot 124 in the base plate post 120 so that the housing or shell 24 is again urged toward the base plate 28 to compress the sealing bead 96. The mechanical arrangement described insures positive and continued stressing compression of the gasket 96 in its housing 92 and against the peripheral marginal face 192 of the base plate 28.

The foregoing description and drawings are provided to illustrate a preferred embodiment of the invention and are intended merely to exemplify the invention in one of its operative modes. It will be appreciated that one skilled in the art will readily recognize many variations and alterations which may be made without the exercise of the inventive faculty. All such variations and alterations including substitution of structual materials are deemed to be within the spirit and scope of the present invention as defined in the appended claims.

What is claimed is:

1. A sealed, water-impermeable, lighting fixture for horizontal and for vertical mounting and including a unitary refractor lens and housing of high impact strength plastics material surmounting and fastened to a base plate of cast metal, said housing comprising a pan-like shell having four perimetric side walls joined to one another at lateral limits thereof to form an endless circumambient wall and subtending and integrally formed with a transversely disposed, generally planar, light-permeable, lens-like panel, junctures of adjacent walls of intersecting said side walls of said shell being blended along radial arcs to form arcuately curved corner structures, and junctures of said side walls with said panel being arcuately blended to provide curved edge portions of said shell, said base plate being of a unitary, die-cast aluminum construction and constituting both heat sink means for dissipating heat generated within said fixture, and floor means for supporting internal mechanical and electrical components of said fixture, contained within said housing, said panel of said shell defining a luminous, window-like lens for transmittal of fixture-derived illuminating light therethrough, said lens being integrally molded as a unitary refractory structure with said side walls of said shell, a pair of preformed, co-extending, parallel, inwardly-concave, outwardly-opening, trough-like reflectors for directing and focusing light emanating from energizable lamps of said fixture, base-plate-supported lamp socket means at an end of each of said trough-like reflectors for supporting elongate lamps to extend generally codirectionally with longitudinal axes of said troughs, said housing and said base plate being formed with cooperating wall means and trench means disposed in overlying and congruently super-imposed spatial orientation for receiving compressibly confined, resiliently-stressed gasket-like sealing means therebetween and seated in said trench means for establishing a fluid-tight seal between said housing and said base plate to prevent entry of moisture into said housing of said fixture, said trench means traversing said base plate about a circumambient marginal zone thereof, resiliently-compressible, endless, bead-like gasket means seated in said trench means throughout a circuitous course thereof and having an uninterrupted exposed surface displaced outwardly of a radial limit of said trench and constituting a sealing face of said gasket means, and fastening means for securing said housing to said base plate for establishing said lighting fixture as a unitary, composite structure.

2. The structure as set forth in claim 1 wherein each reflector of said pair of reflectors defines a reflecting surface delineated by a pair opposed elongate, straight wall sections blending into an intermediately disposed arcuate section coextensive with said wall sections, said arcuate section having a lineally-extending, inwardly-projecting, vaulted mid-zone, said reflectors providing a composite reflecting surface having a modified parabolic form and ensuring excellent luminous efficiency and an enhanced light distribution pattern.

3. The structure as set forth in claim 1 wherein said fastening means comprises interlock means including hinge means and opposed fastener means carried by said shell and by said base plate, said interlock means releasably bonding said shell and said base plate to one another in an inter-sealed, fluid-tight configuration.

4. The structure as set forth in claim 3 wherein said interlock means comprises, in combination, a first post integrally formed with said base plate and extending generally normally thereof and adjacent a first side edge of said base plate, said first post being formed with a socket-like slot extending inwardly of said first post from an outer face thereof and bounded by a shoulder at a lower limit thereof, a tab integrally formed with said shell to project inwardly of a first side wall of said shell and aligned for penetrating entry into said slot of said first post to abut and bear upon said shoulder, thereby to cam said first wall of said shell toward said base plate and to effect a compression of said gasket means between said shell and said base plate to establish a fluid-tight seal therebetween, a second post integrally formed with said base plate and extending generally normally thereof and adjacent a second side edge of said base plate and opposite said first side edge thereof, said second post being formed with a threaded bore for threadedly receiving a locking screw therewithin, said bore being angled upwardly through said second post from an outer face thereof, said shell being formed with a hole extending through a second side wall of said shell opposite said first side wall for registry with said threaded bore in said second post of said base plate, a locking screw having an enlarged head, and having a shank portion extending slidably through said hole in said second side wall of said shell, said screw having a threaded end section threadedly mating with cooperating threads formed in said threaded bore in said second post of said base plate to urge said head of said screw against said second side wall of said shell and simultaneously positively to shift said housing toward said base plate to urge said gasket means at a sealing face thereof into stressed abutment against said base plate and to effect a fluid-tight seal therebetween.

5. The structure as set forth in claim 1 and further comprising metallic pedestal means integrally formed with said base plate on an inside surface thereof and extending upwardly therefrom, electrical ballasts mounted on said pedestal means, said pedestal means comprising heat dissipation means for conductively radiating and dispelling heat generated within said ballasts during operation of said fixture.

6. The structure as set forth in claim 1 and further comprising intercoupling means integrally formed with and circumscribing respective said housing and said base plate for holding said housing and said base plate in aligned and mating registry and for enhancing sealing engagement therebetween, said intercoupling means comprising a skirt-like flange circumscribing said base plate in a zone displaced radially inwardly of an outer edge of said base plate and projecting upwardly therefrom, said flange abutting along an outer lateral face thereof an opposed inwardly presented side surface of said side wall of said housing at a lower edge thereof, and a circumambient rim integrally formed with said housing and projecting downwardly therefrom in a perimetric zone displaced radially outwardly of said trench means and outwardly of said sealing bead seated in said trench means, said rim defining a band enveloping and mechanically abutting said base plate about an outer periphery thereof, said flange of said base plate, in cooperation with said side wall of said housing, and said rim of said housing, in cooperation with said outer periphery of said base plate, constituting baffle means for deterring passage of fluid from an ambient atmosphere into an interior of said fixture, and constituting mechanical interlock means intercoupling said housing and said base plate, and precluding relative radial shifting therebetween.

7. The structure as set forth in claim 1 wherein said base plate is formed with a central opening therethrough defining a passage for electrical wire leads between an interior of said fixture and an ambient system, and a plurality of smaller openings for fixture mounting screws, and further comprising a compressibly-resilient, moisture-impervious sealing pad encircling said central opening in said base plate, and sealing washers encircling said smaller openings, means adhesively bonding said pad and said washers to an underside of said base plate as a moisture barrier to isolate said central opening and said smaller openings to prevent entry of moisture into the interior of said fixture when the latter is mounted on a supporting substrate, thereby rendering said fixture sealed from and effectively impervious to moisture vapor present in the ambient system.

8. The structure as set forth in claim 1 and further comprising skirt means integrally formed with and circumscribing said base plate in a marginal zone thereof, said skirt means extending upwardly of an interface of said base plate and displaced radially inwardly of a perimetric boundary thereof, said skirt means nesting interiorly of and substantially in contact with said side walls of said housing, and constituting means for ensuring proper alignment of said housing with said base plate when in an assembled mode.

* * * * *